US006886286B2

(12) United States Patent
Dowding

(10) Patent No.: US 6,886,286 B2
(45) Date of Patent: May 3, 2005

(54) METHOD OF ATTACHING THE STOCK OF A FIREARM TO A FRAME

(76) Inventor: Samuel F. Dowding, 824 S. Meadow Rd., Raleigh, NC (US) 27603

( * ) Notice: Subject to any disclaimer, the term of this patent is extended or adjusted under 35 U.S.C. 154(b) by 516 days.

(21) Appl. No.: 09/927,140

(22) Filed: Aug. 10, 2001

(65) Prior Publication Data

US 2003/0029070 A1 Feb. 13, 2003

(51) Int. Cl.[7] ..... F41C 7/11; F41A 11/00
(52) U.S. Cl. ..... 42/75.03; 42/71.01
(58) Field of Search ..... 42/71.01, 73, 75.03, 42/106; 89/144, 197; 411/272; 74/567; 403/323, 342, 343, 409.1, 410

(56) References Cited

U.S. PATENT DOCUMENTS

| | | | | |
|---|---|---|---|---|
| 269,152 A | | 12/1882 | Zündorff | |
| 963,444 A | | 7/1910 | Johnson | |
| 1,560,840 A | | 11/1925 | Molloy | |
| 1,583,616 A | | 5/1926 | Smith | |
| 1,828,108 A | | 10/1931 | Flowers | |
| 1,969,255 A | | 8/1934 | Burton et al. | |
| 1,996,124 A | * | 4/1935 | Rowley | 42/75.03 |
| 2,187,640 A | * | 1/1940 | Bost | 42/75 |
| 2,292,351 A | | 8/1942 | Carpenter et al. | |
| 2,365,188 A | | 12/1944 | Gorton | |
| 2,844,904 A | * | 7/1958 | Butler | 42/75 |
| 3,380,182 A | * | 4/1968 | Browning | 42/75 |
| 3,584,533 A | * | 6/1971 | Allyn | 89/144 |
| 3,711,983 A | * | 1/1973 | Allyn | 42/75.03 |
| 3,739,515 A | * | 6/1973 | Koon, Jr. | 42/75 C |
| 3,742,635 A | | 7/1973 | Hutto | |
| 3,999,461 A | * | 12/1976 | Johnson et al. | 89/191.01 |
| 4,027,416 A | | 6/1977 | Berbegal | |
| 4,290,220 A | | 9/1981 | Ruger | |
| 5,173,564 A | * | 12/1992 | Hammond, Jr. | 42/75.03 |
| 5,284,401 A | * | 2/1994 | Harley | 403/409.1 |
| 5,472,269 A | * | 12/1995 | Novikoff | 312/263 |
| 5,799,434 A | * | 9/1998 | Krieger et al. | 42/69.03 |
| 5,813,158 A | | 9/1998 | Campbell et al. | |
| 6,012,246 A | * | 1/2000 | Robinson et al. | 42/71.01 |
| 6,276,868 B1 | * | 8/2001 | Vallance | 403/409.1 |

FOREIGN PATENT DOCUMENTS

| | | |
|---|---|---|
| FR | 2274885 | 9/1976 |
| GB | 2131927 | 6/1984 |

* cited by examiner

*Primary Examiner*—Teri P. Luu
*Assistant Examiner*—B C Hayes
(74) *Attorney, Agent, or Firm*—Coats & Bennett, P.L.L.C.

(57) ABSTRACT

A firearm includes a locking mechanism for securing the stock of the firearm to the frame. The locking mechanism includes a locking member disposed on either the frame or the stock. A cam lock on the other member engages the locking member when the cam lock is rotated to pull the frame and the stock into contact with one another.

34 Claims, 7 Drawing Sheets

METHOD OF ATTACHING THE STOCK OF A FIREARM TO A FRAME

BACKGROUND OF THE INVENTION

The present invention relates generally to long firearms, such as rifles and shotguns, and, more particularly, to a method of attaching the stock of the firearm to the frame in such a manner that the stock can be easily and quickly disassembled from the frame.

The design and construction of long firearms has changed very little since the 19th century. In general, a long firearm includes a frame which contains the firing mechanism and supports the barrel of the firearm. A stock attaches to the frame, typically by means of a long bolt extending through a longitudinal bore in the stock. The longitudinal bore begins at the rear end, typically called the butt, of the stock. The bolt passes through the longitudinal bore and threads into an opening in the frame of the firearm. When the bolt is tightened, the stock is pressed into contact with the frame of the firearm.

The conventional method described above of attaching the stock to the frame of the firearm, while adequate, has some disadvantages. Typically, the butt of the stock is covered by a butt plate to conceal the opening of the longitudinal bore in the stock. To disassemble the stock from the frame, the butt plate must first be removed to allow access to the bolt. This process can be tedious and tends to discourage firearm owners from regularly disassembling the firearm for cleaning.

Accordingly, there is a need for a new method of attaching a stock to the frame of a firearm that allows the stock to be quickly and easily disassembled from the frame for cleaning the firearm or for replacing the stock.

BRIEF SUMMARY OF THE INVENTION

The present invention relates to a firearm with a novel locking mechanism to secure the stock to the frame of the firearm. In one exemplary embodiment, a locking pin having a head portion and a neck portion extends rearwardly from the frame and is received in a longitudinal bore in the stock. The head portion of the locking pin is engaged by a rotating cam to secure the stock to the frame. The rotating cam includes a cavity that receives the head portion of the locking pin when the cam is in the unlocked position and an intersecting slot that receives the neck portion of the locking pin when the cam is rotated to the locked position. A cam surface on the rotating cam exerts a force on the locking pin as the cam is rotated to bring the stock and the frame into firm contact with one another.

The cam is located in a readily accessible location so that the stock can be quickly and easily disassembled from the frame of the firearm by simply rotating the cam 180°. In one embodiment, the cam is received in a bore that extends upwardly from the bottom edge of the stock. In this embodiment, the bore for accommodating the cam may be concealed by a trigger guard or other trim piece. In an alternate embodiment, the cam may extend through a transverse opening in the stock so that one or more ends of the cam are exposed on the side surfaces of the stock. In this embodiment, the exposed end(s) of the cam may have a decorative or ornamental appearance that compliments the overall aesthetic design of the firearm. In another embodiment, the locking pin may extend forwardly from the stock and the cam may be located in the frame.

DETAILED DESCRIPTION OF THE INVENTION

Figure 1:
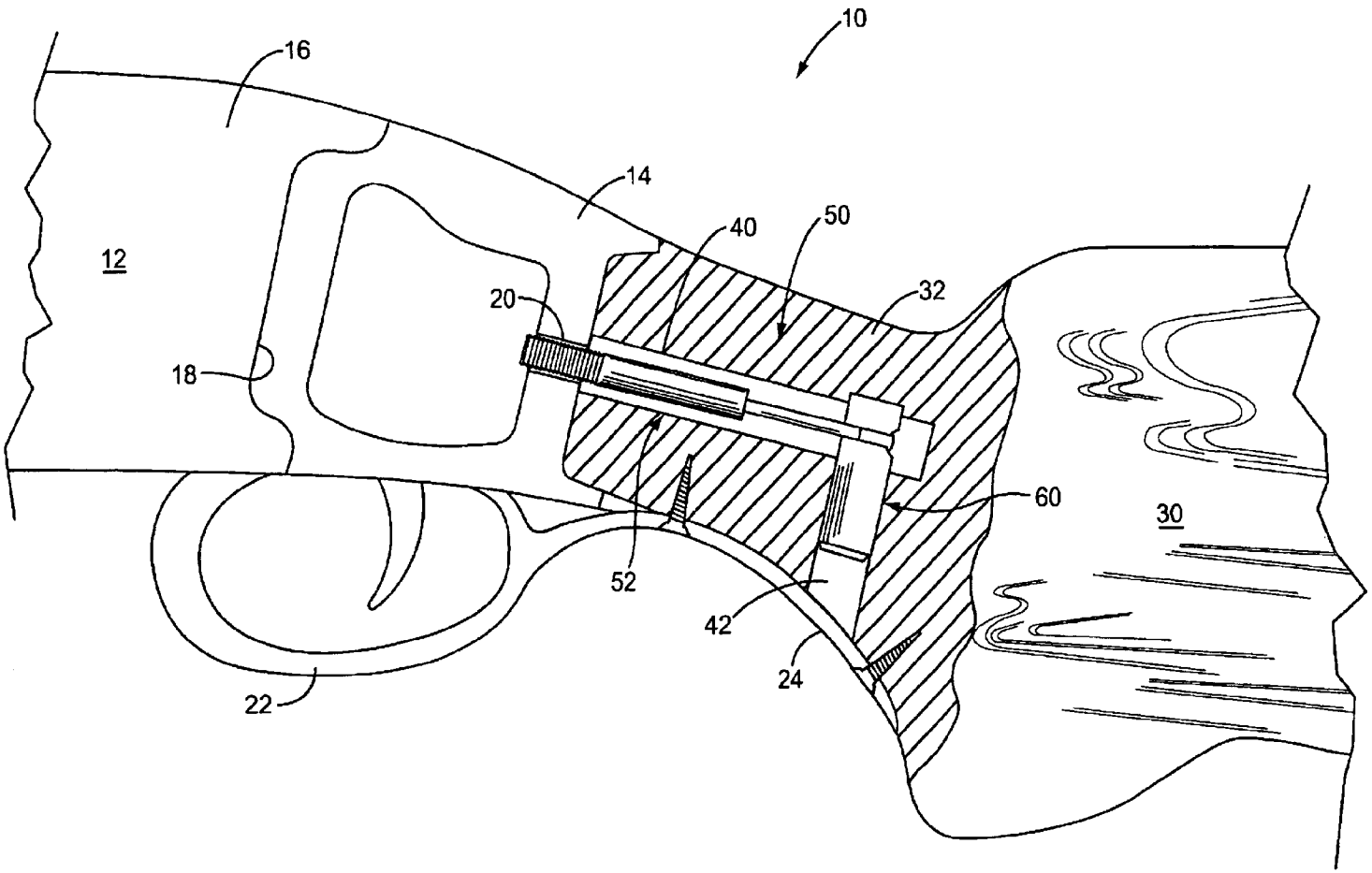
FIG. 1 is a fragmentary elevation view of a firearm with a portion thereof of the stock cut-away to illustrate the cam lock mechanism.

Referring now to the drawings, and particularly to FIG. 1, a firearm constructed in accordance with the present invention is shown therein and indicated generally by the numeral 10. The firearm 10 comprises a frame 12, a stock 30, and a locking mechanism 50 for securing the stock 30 to the frame 12.

The frame 12 is of a conventional construction and only the rear portion of the frame 12 is shown in FIG. 1. The frame 12 includes a tang 14 that projects rearwardly from an intermediate portion 16 of the frame 12. The tang 14 is typically narrower than the intermediate portion 16 of the frame 12 and in conventional fashion is received in a slot 34, also referred to herein as a vertical slot 34 or a vertically-oriented slot 34, formed in the forward end 32 of the stock 30. The intermediate portion 16 of the frame 12 typically has, at its junction with the tang 14, rearwardly-facing shoulders 18 adapted to abut against the forward end 32 of the stock 30. The tang 14 includes a threaded opening 20, which in a conventional firearm receives the end of a bolt that secures the stock 30 to the frame 12. A trigger guard 22 attaches to the bottom of the frame 12. The trigger guard 22 includes an extension that extends along the bottom edge of the stock 30.

Figure 2A:
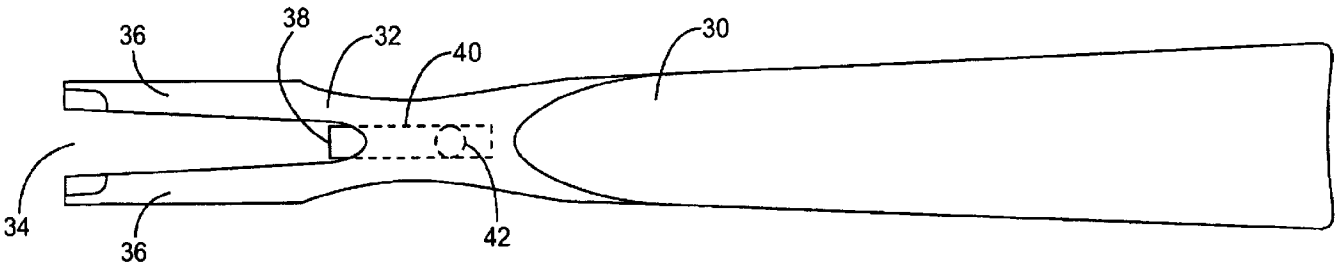
FIGS. 2A and 2B are top elevations view of the stock.
Figure 2B:
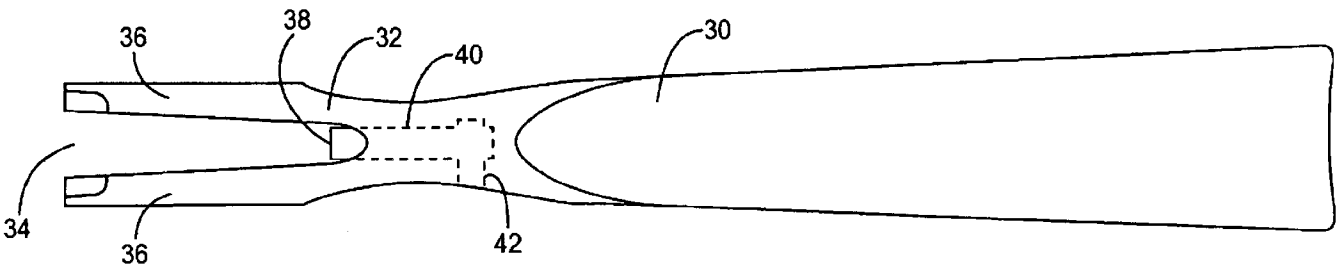

The stock 30, shown in FIGS. 2A and 2B, is typically made of wood or plastic, but may also be constructed of metal or other materials. The forward end 32 of the stock 30 includes a vertically-oriented slot 34 which, as already described, receives the tang 14 of the frame 12. The vertical slot 34 divides the forward end 32 of the stock 30 into right and left side portions 36. When the tang 14 is fully inserted in the vertical slot 34, the rear end of the tang 14 should preferably abut the back wall 38 of the vertical slot 34, and the forward end of the side portions 36 should preferably abut the rearwardly-facing shoulders 18 on the intermediate portion 16 of the frame 12.

A longitudinal bore, referred to herein as the main bore 40, extends rearwardly from the back wall 38 of the vertical slot 34. The purpose of the main bore 40 is to accommodate a locking pin 52, which forms a part of the locking mechanism 50 as will be hereinafter described. In a conventional stock 30, the main bore 40 extends all the way to the rear end of the stock 30 and receives a long bolt inserted from the rear end of the stock 30 that secures the stock 30 to the frame 12. The main bore 40 in the present invention does not need to, but may, extend to the rear end of the stock 30. In that case, the opening of the main bore 40 may be concealed by a butt plate (not shown) on the rear end of the stock 30.

A second bore, referred to herein as the auxiliary bore 42, intersects the main bore 40. The axis of the auxiliary bore 42 is normal to the axis of the main bore 40. In the embodiment of FIG. 2A, the auxiliary bore 42 extends upward from the bottom edge of the stock 30. Alternatively, the auxiliary bore 42 could extend transversely through the stock as shown in FIG. 2B.

The auxiliary bore 42 contains a cam 60 that forms a part of the locking mechanism 50. In the disclosed embodiment, the opening of the auxiliary bore 42 in the bottom edge of the stock 30 is concealed by the rearward extension 24 of the trigger guard 22. Those skilled in the art will recognize, however, that other methods of concealing or closing the opening could be used.

The locking mechanism 50 includes a locking member and a cam 60. The locking member in the embodiment of FIG. 1 comprises a locking pin 52 extending rearwardly from the frame 12 and is received in the main bore 40 of the stock 30 as shown in FIG. 1. The auxiliary bore 42 in the stock 30 receives the cam 60, which engages the locking pin 52 to secure the stock 30 to the frame 12.

Figure 3:
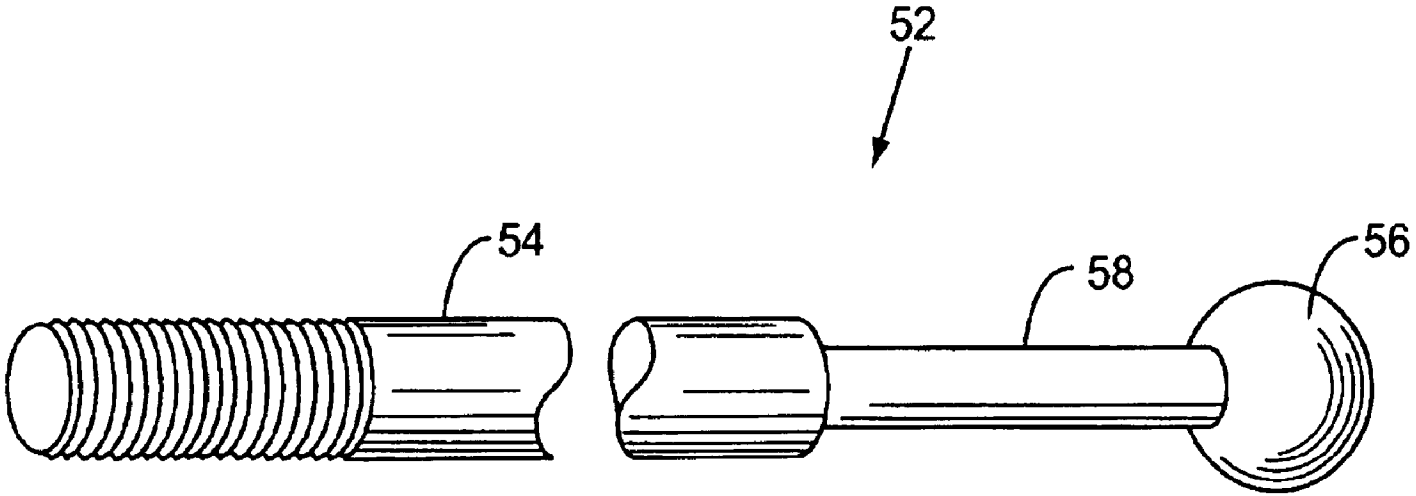
FIG. 3 is a perspective view illustrating the locking pin used in the cam lock mechanism.
Figure 5:
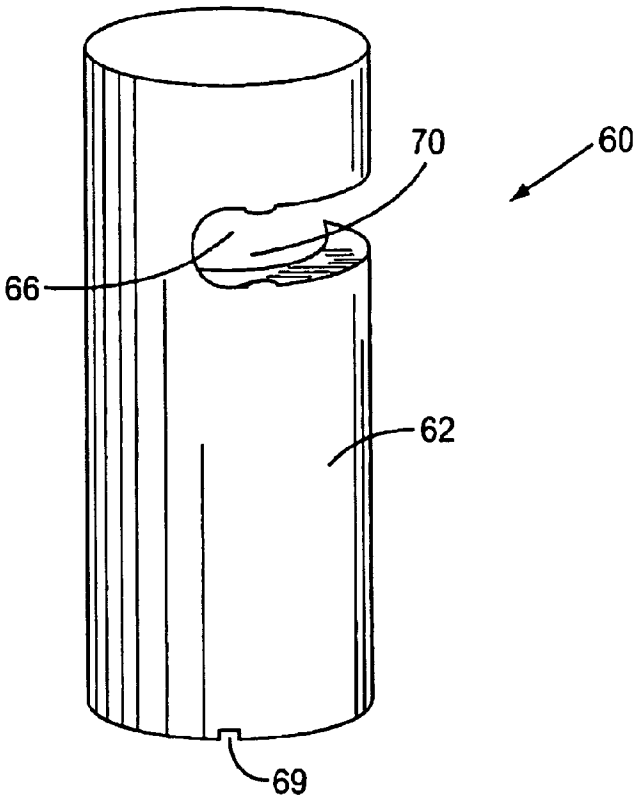
FIG. 5 is a perspective view of the cam used in the cam lock mechanism as seen from the rear.
Figure 4:
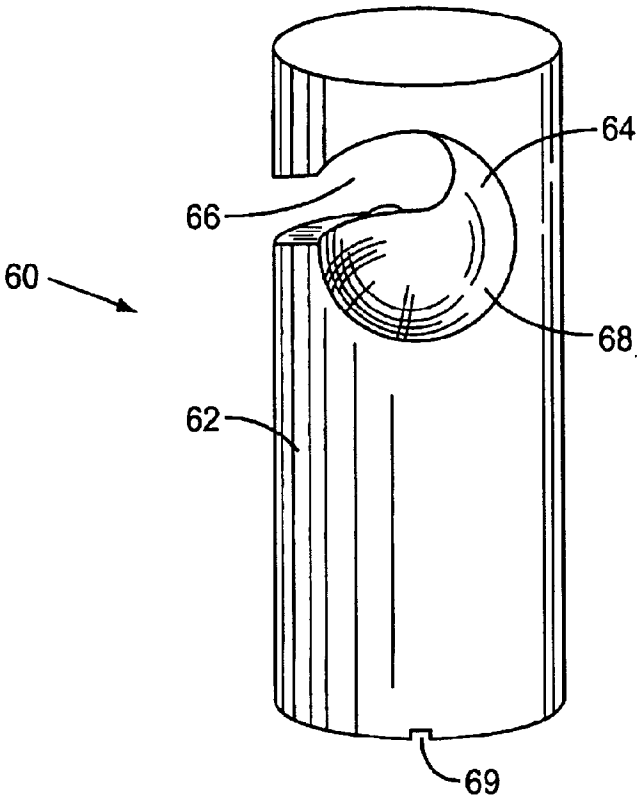
FIG. 4 is a perspective view of the cam used in the cam lock mechanism as seen from the front.

FIGS. 3–5 illustrate the components of the locking mechanism 50 in more detail. The locking pin 52, shown in perspective view in FIG. 3, comprises an end portion 54, a head portion 56, and a neck portion 58. The end portion 54 is externally threaded and sized to thread into the opening 20 located in the tang 14 of the frame 12. The head portion 56 has a generally spherical configuration, however, other forms may also be used. The neck portion 58 connects the head portion 56 to the end portion 54. Neck portion 58 is smaller in diameter than the end portion 54 and head portion 56.

The cam 60, shown in FIGS. 4 and 5, comprises a cylindrical main body 62 having a generally spherical cavity 64 to receive the head portion 56 of the locking pin 52 and a slot 66. The cam 60 rotates between a locked position and an unlocked position. The slot 66 is sized to receive the neck portion 58 of the locking pin 52 when the cam 60 is rotated to a locked position as hereinafter described. The width of slot 66 is less than the diameter of the head portion 56 so that the head portion 56 is captured when the cam 60 rotates to a locked position. A tool slot 69 is formed on the bottom end of the cam 60, which can be engaged by a flat blade screwdriver to rotate the cam 60 between the locked and unlocked positions.

In a preferred embodiment, the slot 66 has a slight restriction 70 formed by varying the width of the slot 66. The width of the restriction 70 is slightly smaller than the diameter of the neck portion 58. When the cam 60 is rotated to the locked position, the neck portion 58 must pass through the restriction 70 in the slot 66. Thus, the restriction 70 prevents the cam 60 from inadvertently rotating from a locked position during use of the firearm 10. Other means could also be devised to prevent rotation of the cam 60 during use. For example, a detent mechanism, spring-biased pawl, or stop could engage the cam 60 to prevent it from rotating. The cam 60 could also be held by friction or the cam 60 itself could be biased by a spring.

Cavity 64 is disposed off center with respect to the axis of rotation of the cam 60. Thus, when the cam 60 is rotated, the wall of the cavity 64 functions as a cam surface 68 to exert a force on the head portion 56 of the locking pin 52. Since the locking pin 52 is connected to the frame 12, the force exerted by the cam surface 68 on the head portion 56 of the locking pin 52 pulls the frame 12 and stock 30 together.

Figure 6A:
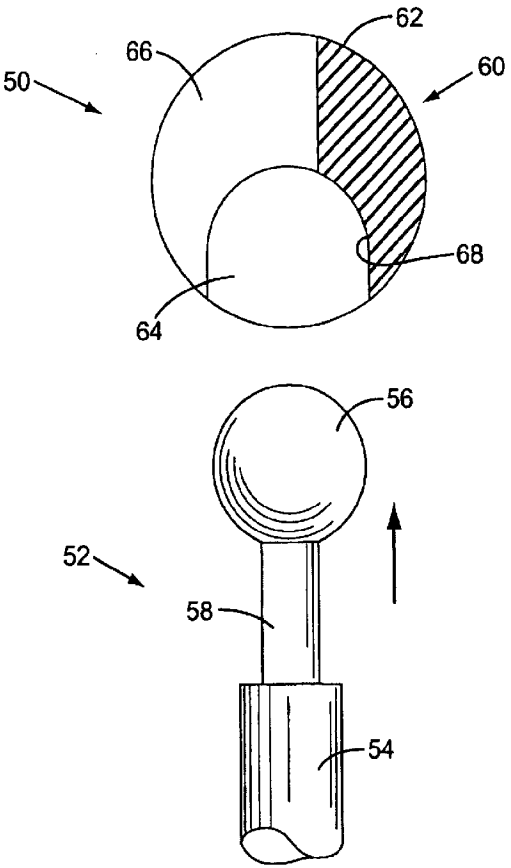
FIGS. 6A–6C are cross-sections of the cam lock mechanism illustrating how the cam lock mechanism operates.
Figure 6C:
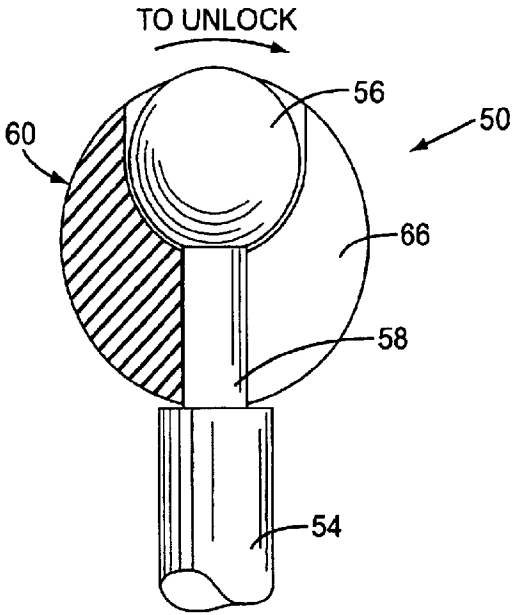
Figure 6B:
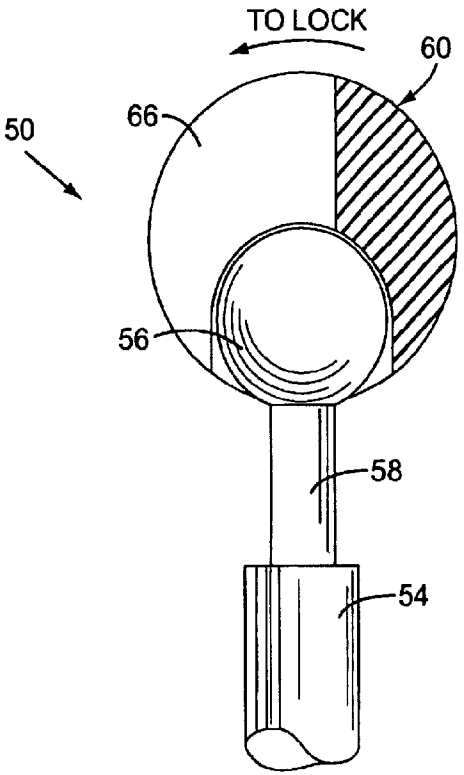

FIGS. 6A–6C illustrate the operation of the locking mechanism 50. The locking pin 52 is threaded into the opening 20 located in the tang 14 of the frame 12 as shown in FIG. 1, and the cam 60 is inserted into the auxiliary bore 42 in the stock 30. In the position shown in FIG. 6A, the tang 14 is not fully inserted into the vertical slot 34 of the stock 30. The cam 60 is in an unlocked position with the cavity 64 facing forwardly and aligned with the longitudinal axis of the locking pin 52.

When the frame 12 is fully inserted into the slot 34 of the stock 30, the head portion 56 of the locking pin 52 is received in the cavity 64 of the cam 60 as shown in FIG. 6B. Once the frame 12 is fully inserted, the cam 60 is rotated in the direction shown in FIG. 6B to lock the stock 30 to the frame 12. As described above, when the cam 60 is rotated, the cam surface 68 exerts a force on the head portion 56 of the locking pin 52 that urges the stock 30 and frame 12 into contact with one another. If the stock 30 remains loose after the cam 60 is rotated to the locked position shown in FIG. 6C, the effective length of the locking pin 52 can be shortened by threading the locking pin 52 further into the opening 20 in the frame 12. For purposes of this application, the effective length of the locking pin 52 is the distance that the locking pin 52 extends from the rear end of the tang 14. Shortening the effective length of the locking pin 52 produces a tighter fit between the stock 30 and frame 12; whereas increasing the effective length of the locking pin 52 produces a looser fit. If desired, one or more nuts may be threaded onto the end portion 54 of the locking pin 52 to prevent the locking pin 52 from backing out of the opening 20 during use, which could cause the stock 30 to become loose over a long period of use.

Figure 7:
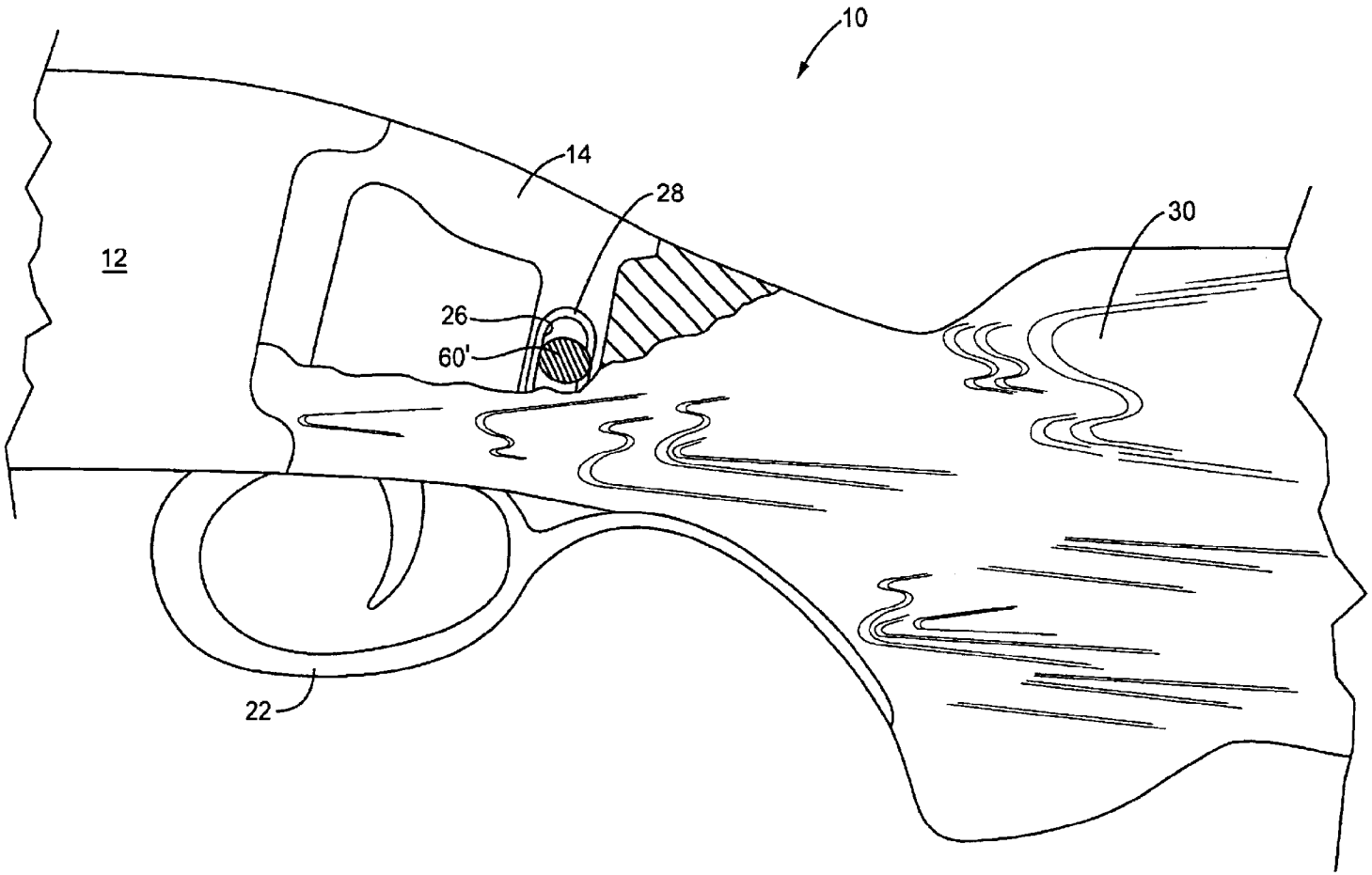
FIG. 7 is an elevation view of an alternate embodiment of the firearm with a portion thereof shown in section to illustrate the locking mechanism.

FIG. 7 illustrates an alternate embodiment of the firearm 10 of the present invention. The alternate embodiment uses many of the same parts as the first embodiment. Therefore, whenever appropriate, the reference numbers used to described the first embodiment will also be used to describe analogous components in the second embodiment.

The firearm 10 shown in FIG. 7 includes a frame 12 and stock 30. The frame 12 includes a tang 14 that is received in a slot 34 (FIGS. 2A and 2B) in the stock 30 as previously described. In the embodiment shown in FIG. 7, the tang 14 functions as a locking member so that a locking pin 52 is not required. In this embodiment, the tang 14 includes a lateral opening 26 that receives a cam 60'. At least an intermediate portion of the cam 60' has an eccentric cross-section as shown in FIG. 7. When the cam 60' is rotated, the eccentric surface of the cam 60' pushes against the side wall of the lateral opening 26.

In this embodiment, the frame 12 is inserted into the stock 30 and then the cam 60' is inserted through the lateral opening 26 in the tang 14. Some means is therefore needed to prevent the axial movement of the cam 60' once it is rotated to the locked position. For example, the wall of the lateral opening 26 may include a channel 28 which captures the eccentric portion of the cam 60'. Other methods could also be used to prevent axial movement of the cam 60' once it is rotated to the locked position.

The description of the invention contained herein represents only one implementation of the invention, and those skilled in the art will recognize that other implementations are possible. For example, the cam 60 could be orientated to rotate about a horizontal axis that extends transversely through the stock 30. In this case, the ends of the cam 60 may be exposed and have an ornamental or decorative appearance that complements the overall aesthetics of the firearm 10. Also, those skilled in the art will recognize that the cam 60 could be located in the frame 12 rather than the stock 30. These and other variations of the invention are intended to be included within the scope of the claims.

What is claimed is:

1. A long firearm comprising:

a. a frame;

b. a locking member extending rearwardly from the frame;

c. a stock having a longitudinal bore extending from the forward end of the stock to receive the locking member when the stock is mounted to the frame;

d. a cam lock disposed in the stock and rotatable between a locked position and an unlocked position for engaging the locking member when the cam lock is rotated to the locked position to secure the stock to the frame.

2. The firearm of claim 1 wherein the cam lock has a cavity to receive a portion of the locking member when the cam lock is in the unlocked position, and wherein the locking member is captured in the cavity when the cam lock is rotated to the locked position.

3. The firearm of claim 2 wherein the locking member includes a head portion that is captured by the cam lock when the cam lock is rotated to the locked position.

4. The firearm of claim 3 wherein the cam lock includes a cam surface that engages the head portion of the locking member and pulls the stock into contact with the frame when the cam lock is rotated.

5. The firearm of claim 4 wherein the locking member further includes a neck portion connected to the head portion, and wherein the head portion is larger in girth than the neck portion.

6. The firearm of claim 5 wherein the cam lock further comprises a slot that receives the neck portion of the locking member when the cam lock is rotated to the locked position.

7. The firearm of claim 6 wherein the slot in the cam lock includes a restriction to prevent the cam lock from rotating when the cam lock is in the locked position.

8. The firearm of claim 1 wherein the stock includes a cam opening intersecting the longitudinal bore in the stock to receive the cam lock.

9. The firearm of claim 8 wherein the cam opening extends generally vertically through the stock and the cam lock rotates about a substantially vertical axis.

10. The firearm of claim 9 wherein the cam lock extends upward from a bottom edge of the stock.

11. The firearm of claim 8 wherein the cam opening extends transversely through the stock and the cam lock rotates about a generally horizontal axis.

12. The firearm of claim 1 further including means to prevent rotation of the cam lock when the cam lock is in the locked position.

13. The firearm of claim 1 wherein the locking member includes a cam opening to receive the cam lock and wherein the cam lock engages the wall of the cam opening when the cam lock is rotated to the locked position.

14. The firearm of claim 1 wherein the effective length of the locking member is adjustable.

15. The firearm of claim 14 wherein the locking member includes a threaded end portion that threads into an opening in the frame.

16. A long firearm comprising:

a. a frame;

b. a stock;

c. a securing mechanism for securing the stock to the frame, said securing mechanism including a locking member disposed on either the frame or the stock and a cam lock disposed in the other one of the two parts to engage the locking member;

d. wherein the cam lock is rotatable about an axis between a locked position and an unlocked position; and e. wherein the cam lock engages the locking member when it is rotated to the locked position.

17. The firearm of claim 16 wherein the cam lock has a cavity to receive a portion of the locking member when the cam lock is in the unlocked position, and wherein the locking member is captured in the cavity when the cam lock is rotated to the locked position.

18. The firearm of claim 17 wherein the locking member includes a head portion that is captured by the cam lock when the cam lock is rotated to the locked position.

19. The firearm of claim 18 wherein the cam lock includes a cam surface that engages the head portion of the locking member and pulls the stock into contact with the frame when the cam lock is rotated.

20. The firearm of claim 18 wherein the locking member further includes a neck portion connected to the head portion, and wherein the head portion is larger in girth than the neck portion.

21. The firearm of claim 20 wherein the cam lock has a slot that receives the neck portion of the locking member when the cam lock is rotated to the locked position.

22. The firearm of claim 21 wherein the slot in the cam lock includes a restriction to prevent the cam lock from rotating when the cam lock is in the locked position.

23. The firearm of claim 16 wherein the cam lock rotates about a generally vertical axis.

24. The firearm of claim 16 wherein the cam lock rotates about a generally horizontal axis.

25. The firearm of claim 16 further including means to prevent rotation of the cam lock when the cam lock is in the locked position.

26. The firearm of claim 16 wherein the locking member includes a cam opening to receive the cam lock and wherein the cam lock engages the wall of the cam opening when the cam lock is rotated to the locked position.

27. A method of securing a stock to a frame of a long firearm comprising:

a. engaging a locking member disposed in either the frame or the stock with a cam lock disposed in the other one of the frame or the stock; and b. rotating the cam lock to draw the frame and the stock into contact with one another.

28. The method of claim 27 wherein engaging the locking member with the cam lock comprises capturing a portion of the locking member in an opening formed in the cam lock.

29. The method of claim 27 wherein engaging the locking member with the cam lock comprises inserting the cam lock in an opening in the locking member.

30. A firearm comprising:

a. a frame;

b. a stock; and c. locking means including a cam lock rotatable between locked and unlocked positions for securing the stock to the frame.

31. The firearm of claim 30 wherein the locking means further comprises a locking member engaged by the cam lock.

32. The firearm of claim 31 wherein the locking member includes a head portion that is captured in a cavity in the cam lock when the cam lock is rotated to the locked position.

33. The firearm of claim 32 wherein the locking member includes a cam opening that receives the cam lock.

34. The firearm of claim 31 further comprising means to prevent the cam lock from rotating from the locked position to the unlocked position.

* * * * *